United States Patent [19]

Grimm et al.

[11] 4,250,719

[45] Feb. 17, 1981

[54] HOUSEHOLD REFRIGERATOR HUMIDITY CONTROLLED PAN ASSEMBLY

[75] Inventors: Bernard J. Grimm; Richard A. Dossett, both of Louisville, Ky.

[73] Assignee: General Electric Company, Louisville, Ky.

[21] Appl. No.: 71,971

[22] Filed: Sep. 4, 1979

[51] Int. Cl.[3] ..... F25D 25/02

[52] U.S. Cl. ..... 62/382; 62/408; 312/270

[58] Field of Search ..... 62/382, 408; 312/270, 312/330 R

[56] References Cited

U.S. PATENT DOCUMENTS

| | | | |
|---|---|---|---|
| 2,237,820 | 4/1941 | Hill | 62/382 |
| 2,306,802 | 12/1942 | Harbison | 62/89 |
| 3,473,345 | 10/1969 | Pfeiffer et al. | 62/382 |
| 3,860,942 | 11/1958 | Carew | 312/270 |
| 4,013,434 | 3/1977 | Kronenberger et al. | 62/382 |
| 4,173,378 | 11/1979 | Hanson et al. | 62/382 |

*Primary Examiner*—Ronald C. Capossela

*Attorney, Agent, or Firm*—Frederick P. Weidner; Radford M. Reams

[57] ABSTRACT

A refrigerator having a humidity controlled pan assembly which includes a storage pan having an open top and a stationary cover inside the refrigerator for receiving the pan. A cover panel within the stationary cover is movable back and forth along the top of the pan by a movable control mechanism and linkage between the control mechanism and the cover panel that moves the cover panel back and forth along the top of the pan in response to movement of the control mechanism. With this arrangement, the user of the refrigerator may move the control mechanism to increase or decrease the amount of ventilation and, thus, control the humidity inside the pan.

10 Claims, 6 Drawing Figures

HOUSEHOLD REFRIGERATOR HUMIDITY CONTROLLED PAN ASSEMBLY

BACKGROUND OF THE INVENTION

This invention relates to household refrigerators such as a combination refrigerator—that is, a refrigerator including a freezer compartment on top and a fresh food compartment below, both of which are cooled by circulating air from the two compartments over a single evaporator employing a single fan to accomplish the circulation. This invention relates to controlling the humidity of a storage container in the fresh food compartment of the refrigerator.

Combination refrigerators, including a single evaporator and a single fan for circulating air from the freezer and fresh food compartments over the evaporator are well known. In the operation of such refrigerators, a major portion of the refrigerated air from the evaporator is directed into the freezer compartment while a smaller portion is directed into the fresh food compartment. When cold air from the freezer compartment is used to cool the refrigerator compartment, such air, because of its relative dryness, should not directly contact the fresh foods as they will become dried out and lose their freshness. The fresh foods are desirably isolated from the desiccating effect of the colder air so that they may be kept cool, yet moist. Sealed compartments or pans have heretobefore been used for this purpose. It is desirable, however, that such pans have the humidity inside the pan adjustable or controllable to provide the desired humidity, depending upon the type of food load. The food load is the source of moisture inside the pan. Certain types of food have more moisture that will raise the humidity inside the pan as compared to other types of food. Moreover, certain types of food, such as green vegetables, should best be stored at a high relative humidity, while others should not. Also, different degrees of humidity are desirable according to the amount of food placed in the pan. Small loads tend to dry out more so than larger loads. Various arrangements have been used to adjust pan ventilation and, therefore, the humidity inside the pan. See, for example, U.S. Pat. Nos. 2,237,820; 2,306,802; 2,860,942 and 4,013,434.

By our invention, there is provided a humidity controlled pan assembly in a refrigerator whereby the user of the refrigerator may adjust the amount of humidity inside the pan.

SUMMARY OF THE INVENTION

According to one aspect of our invention, there is provided a humidity controlled pan assembly in a refrigerator. The assembly includes a storage pan having an open top and a stationary cover inside the refrigerator for receiving the pan. There is a cover panel within the stationary cover movable back and forth along the top of the pan and control means, including a movable control mechanism and linkage means between the control mechanism and the cover panel that moves the cover panel back and forth along the top of the pan in response to movement of the control mechanism. With this arrangement, the user of the refrigerator may move the control mechanism to increase or decrease the amount of ventilation and, thus, control the humidity inside the pan.

DESCRIPTION OF THE PREFERRED EMBODIMENT

Figure 1:
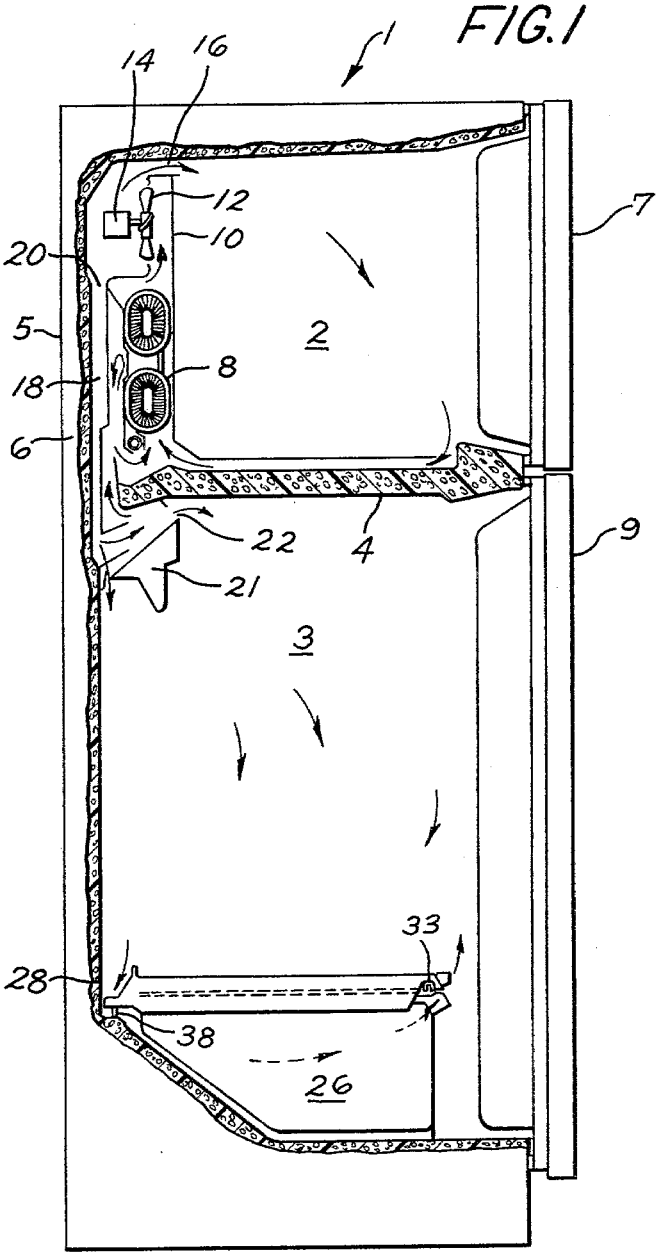
FIG. 1 is a side elevational view, partly in section, of a refrigerator cabinet having a freezer compartment on top and a fresh food compartment on the bottom and embodying one form of the present invention.
Figure 2:
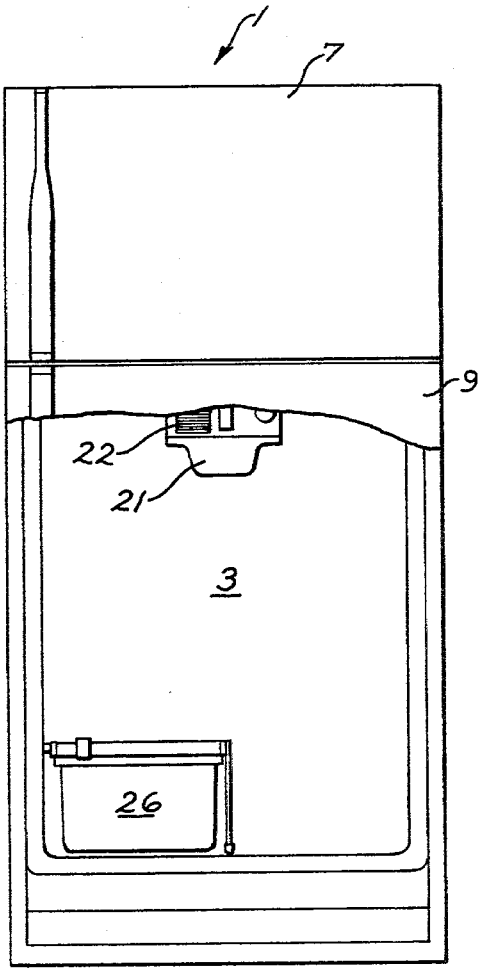
FIG. 2 is a front elevational view of the refrigerator of FIG. 1 having one form of the present invention embodied therein.

With particular reference to FIGS. 1 and 2 of the drawings, there is shown one embodiment of the present invention in the form of a household refrigerator 1, including an upper freezer compartment 2 and a lower fresh food compartment 3 separated from the freezer compartment by an insulated partition 4. The respective compartments are also separated from the outer shell or outer cabinet walls 5 and the spaces between the compartments and these walls are filled by means of insulation 6. A hinged door 7 permits access to the freezer compartment 2 and a hinged door 9 permits access to the fresh food compartment 3.

Both of the compartments are maintained at the desired refrigerating temperatures by means of a single evaporator 8 which operates at a below freezing temperature and is arranged within the freezer compartment 2 and separated from the food storage area of the freezer by a liner 10 for protection purposes. For directing air cooled by the evaporator 8 into the two compartments 1 and 2, there is provided a forced air circulating system, including a single air circulating means in the form of a fan 12 driven by a motor 14. Most of the air flow passes into the forward or food storage area portion of the freezer compartment 2 through air passage 16 while a smaller portion of the air is directed through an air duct 18 which is located at the rear of the compartments. The air duct 18 has an air inlet opening 20 in the freezer compartment 2 where the cold air enters the air duct and then it is directed downwardly to the fresh food compartment 3. The air duct 18 has a baffle 21 with a discharge opening 22 for introducing the cold air into the top of the fresh food compartment 3.

In household refrigerators, it is desirable to provide a pan in the fresh food compartment 3 in which fresh fruits and vegetables may be kept. As shown in FIGS. 1 and 2, there is a pan 26 located at the bottom of the fresh food compartment 3. It is desirable to control the humidity in the pan 26 and this may be accomplished by controlling the amount of ventilation of the pan 26. To accomplish this, there is provided a humidity controlled pan assembly, the operation and function of which will now be described.

Figure 3:
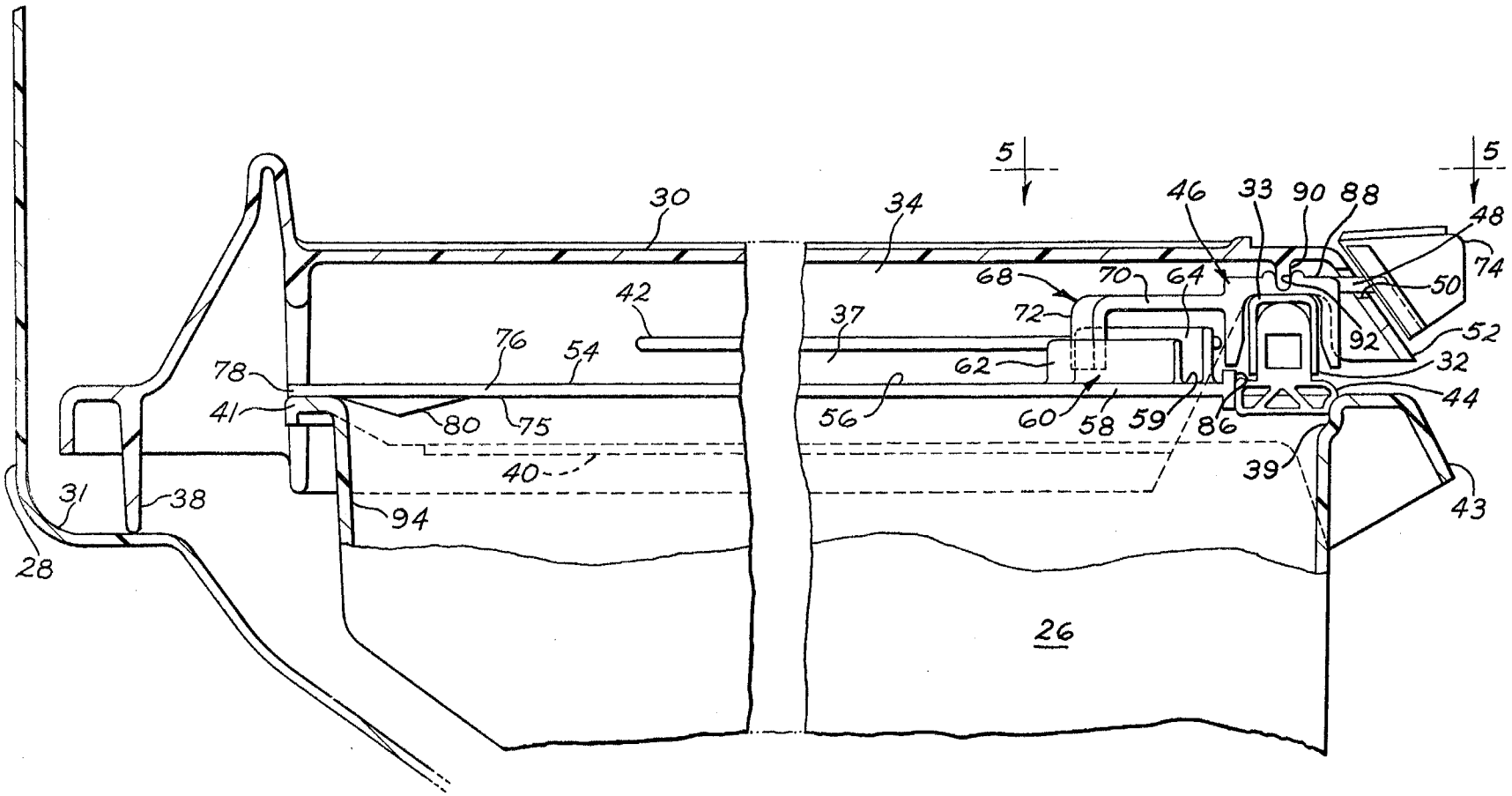
FIG. 3 is a cross sectional view of the humidity controlled pan assembly of the present invention showing one position of the control means.

There is a stationary cover 30 which is secured to the inside of the fresh food compartment 3 by means of a rigid support member 32 having a channel 33. The rigid support member 32 passes through both of the downwardly depending side flanges 34 and 36 of the stationary cover 30 and is attached to the inner wall of the fresh food compartment by any suitable means such as screws. The rear of the stationary cover 30 has a downwardly depending flange 38 which rests on a curved portion 31 of the rear liner wall 28. The stationary cover 30 has an inwardly open channel on both side flanges 34 and 36 dimensioned to slidably receive the pan 26. Both channels are of the same configuration. For instance, the channel on flange 34 uses the inner surface 37 of the flange as the bottom wall and the two legs 40 and 42 are formed on the inner surface of flange 34 which are parallel to and spaced from each other to receive an outwardly directed horizontal depending flange or lip 41 which extends around the top periphery of the pan 26. It will be understood that the pan 26 may be removed from the stationary cover 30 for cleaning, etc. and slides back and forth under the stationary cover on the tracks or channels provided in the side flanges 34 and 36 of the stationary cover 30. For ease of movement, there is a handle 43 on the front wall 39 of the pan 26. To seal the pan 26 across the top of the front wall 39 of pan 26 when the pan is in the completely rearward position relative to the stationary cover 30, as shown in FIG. 3, there is provided along the front of the stationary cover 30 a resilient gasket 44 which abuts the front wall 39. The gasket 44 is retained in its proper stationary position by being supported in the channel 33 of the rigid support member 32 that supports the stationary cover 30.

Figure 6:
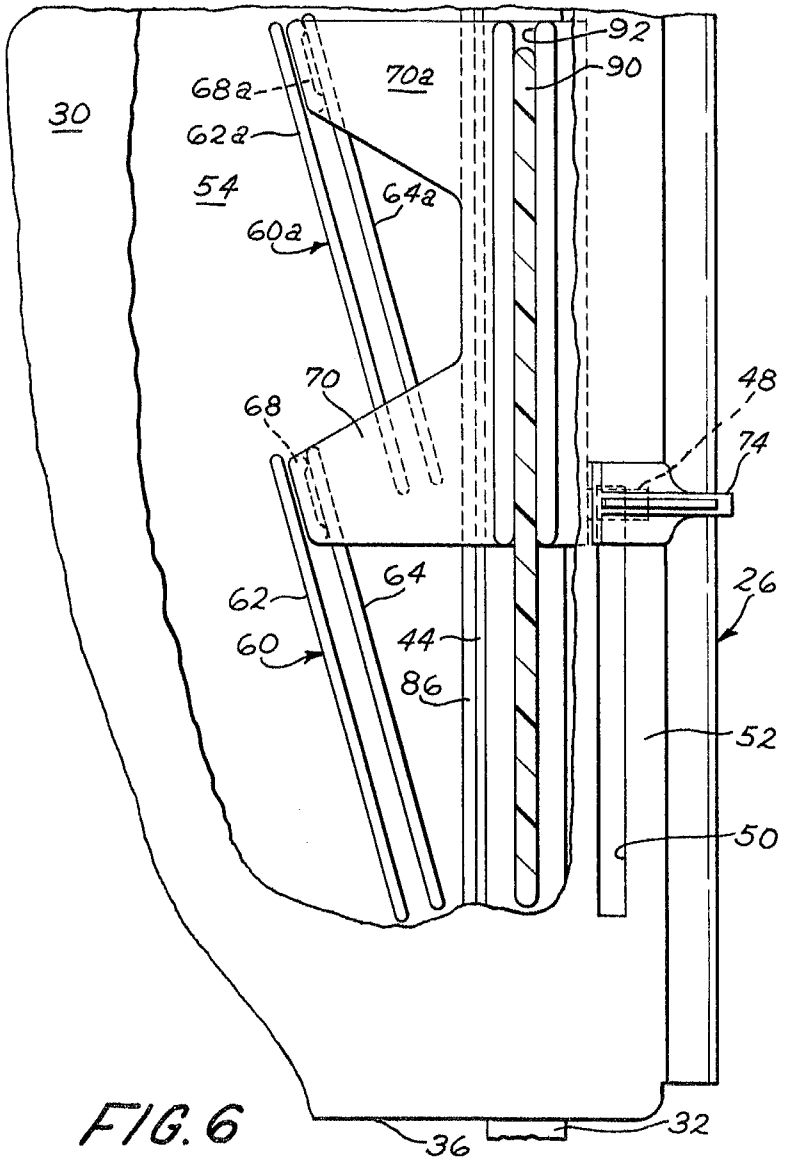
FIG. 6 is a fragmentary top plan view taken along lines 6—6 of FIG. 4 with portions broken away of the humidity controlled pan assembly of the present invention showing the control means in a second position.
Figure 5:
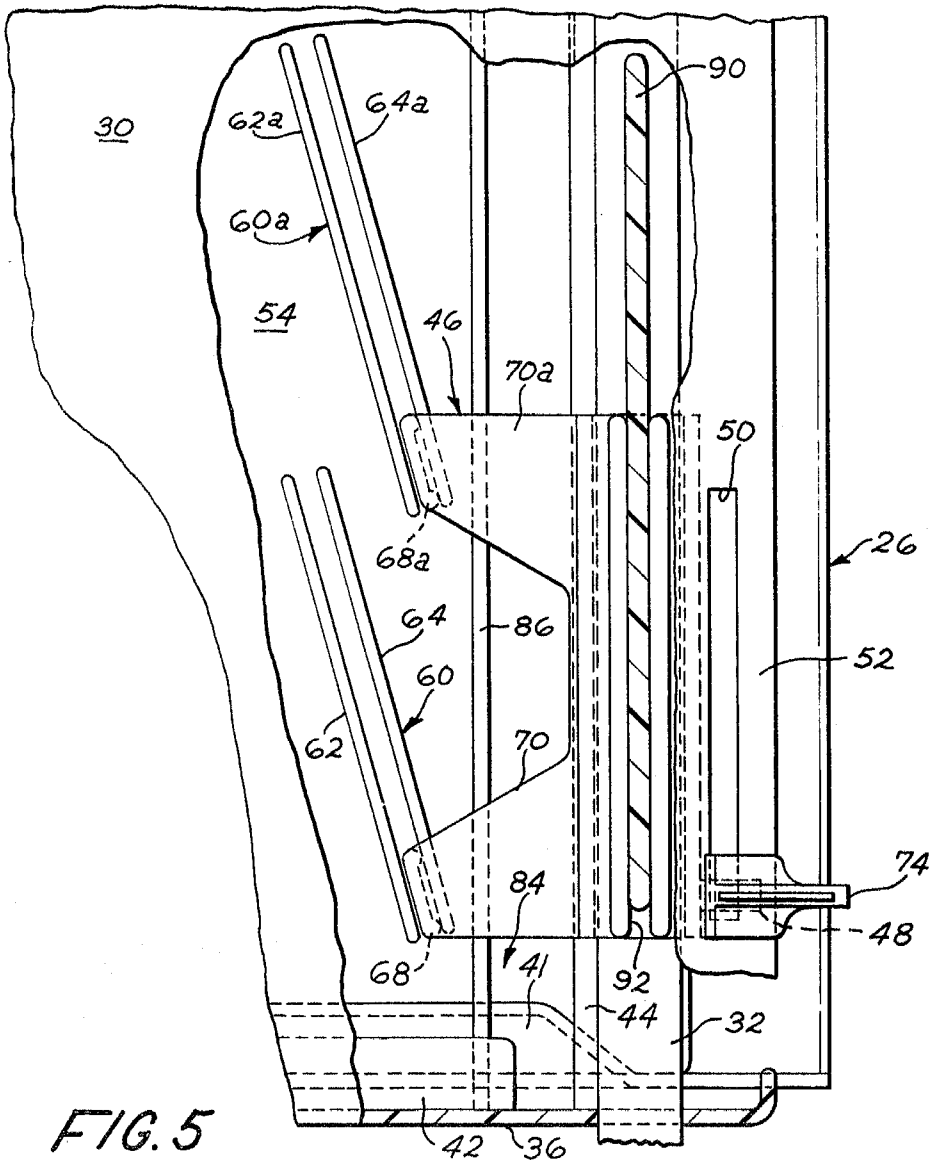
FIG. 5 is a fragmentary top plan view taken along lines 5—5 of FIG. 3 with portions broken away of the humidity controlled pan assembly of the present invention showing the control means in one position.

Control means are provided for controlling or adjusting the amount of ventilation of the interior of the pan 26 and, therefore, the humidity in the pan and includes a movable control mechanism 46 which is located at the front of the storage pan 26. In the preferred embodiment the control mechanism 46 is slidably mounted and has an arm 48 that passes through a horizontal slot 50 located on a panel 52 on the front of the stationary cover 30. There is a cover panel 54 retained within the stationary cover in the inwardly open channels on both side flanges 34 and 36 and is movable back and forth along the top of the pan 26. The cover panel 54 is dimensioned to be as large as the top opening of the pan 26 so thas in one position of the control mechanism 46, the top of the pan 26 is completely covered. The top surface 56 of cover panel 54 has, at the forward end 58 thereof, at least one cam track member 60 which is in the form of a channel wherein the bottom wall 59 of the cam track member 60 is the top surface 56 of the panel cover 54 and the other two legs 62 and 64 are parallel to each other and spaced apart and perpendicular to the top surface 56 of cover panel 54. The cover panel 54 is made from plastic material so the cam track member 60 may be integrally molded therein. As can be seen in FIGS. 5 and 6, the preferred embodiment includes two parallel cam track members 60 and **60*a*** which are laterally spaced from each other.

Figure 4:
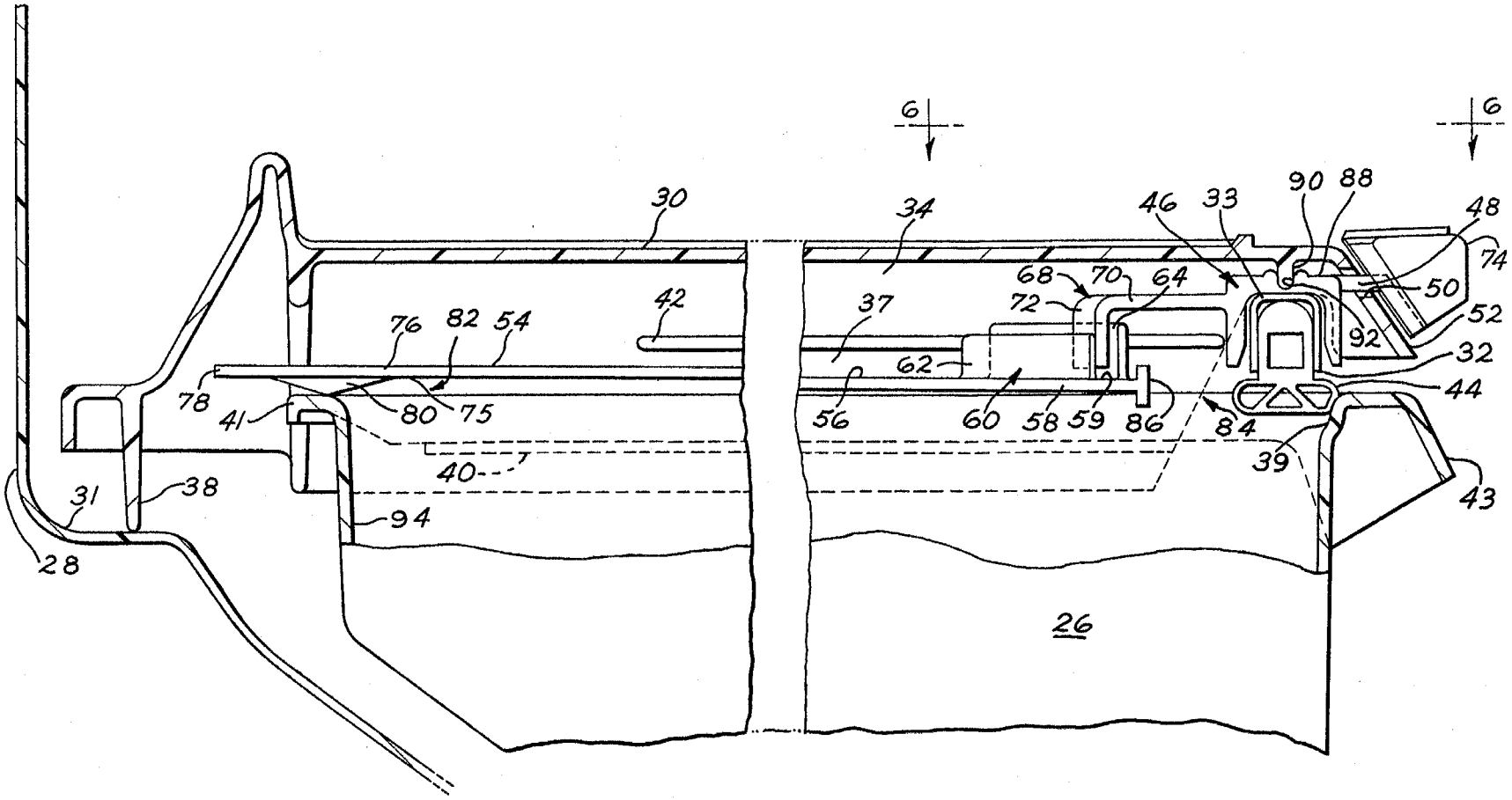
FIG. 4 is a cross sectional view of the humidity controlled pan assembly of the present invention showing a second position of the control means.

There is provided linkage means between the control mechanism 46 and the cover panel 54 that moves the cover panel 54 back and forth along the top of the pan in response to movement of the control mechanism 46. The linkage means inludes a cam follower member 68 which is rididly secured or fastened to the movable control mechanism 46 and is L-shaped in cross section, as shown in FIGS. 3 and 4, and comprises one leg 70 which is horizontal relative to the cover panel 54 and a second downwardly depending leg 72 which is received in the cam track member 60 and is movable along the length of the cam track member 60. With the cam follower member 68 being movable within the cam track member which is molded integral with the cover panel 54, movement of the control mechanism 46 causes the cam follower member 68 to move along the track of the cam track member 60, thus causing the cover panel 54 to move back and forth relative to the stationary cover 30 and pan 26. As can be seen in FIGS. 5 and 6, the preferred embodiment includes two cam follower members 68 and **68*a* that are received in cam track members 60 and 60*a***, respectively. This kind of arrangement adds stability to the structure and enhances ease of movement of the moving components.

The movable control mechanism 46 is provided with an arm 48 that passes through the horizontal slot 50 and has a knob 74 attached to it so that the refrigerator user may easily move the control mechanism 46 to a position which will move the cover panel 54 relative to the top of pan 26 and thus control or adjust the amount of ventilation of the pan 26 which controls the humidity in the pan 26. The desired amount of humidity will depend upon the type of food load and volume of food load in the pan 26.

On the bottom surface 75 of the rear portion 76 of the cover panel 54, there may be one or more ramp elements 80 spaced across the cover panel 54 which are utilized to raise the cover panel 54 relative to the rim 41 of storage pan 26 to provide a gap 82 when the cover panel 54 is moved rearward in response to moving the control mechanism 46, as shown in FIG. 4. This allows venting of the interior of the pan 26 at the top of the pan along the sides and rear, while the front of the pan 26 is vented by providing a gap 84 between the front end 86 of the cover panel 54 and gasket 44.

With reference to FIGS. 3 and 5, one extreme setting of the control mechanism 46 is shown. When knob 74 and arm 48 and, therefore, control mechanism 46 are in the position shown, leg 72 of the cam follower member 68 is located in the cam track member 60 at a point closest to the front wall 39 of the pan 26 and panel 52 of the stationary cover 30. In this position, the control mechanism has moved the cover panel 54 toward the front of the pan, whereupon the front 86 of the cover panel 54 engages gasket 44 to seal across the front of the pan 26, while the rear portion 76 of the cover panel is moved to disengage the ramp element 80 from the top of the pan 26 and allows the inner surface 75 of cover panel 54 to rest in sealing engagement with the lip 41 at the top of the pan.

With reference to FIGS. 4 and 6, the other extreme setting of the control mechanism 46 is shown. In this setting, leg 72 of the cam follower member 68 is located in the cam track member 60 at a point furtherest from the front wall 39 of the pan 26 and panel 52 of the stationary cover 30. In this position, the control mechanism 46 through the cam follower member 68 and cam track member 60 has moved the cover panel 46 rearward, thus opening up the gap 84 between the gasket 44 and the front end 86 of the cover panel, allowing maximum ventilation of the pan at the front thereof. In the same operation, the ramp element 80 has engaged lip 41 at the top of the pan 26 and raised the rear portion 76 of the cover panel 54 above the top of the pan 26 to provide the gap 82 along the sides and rear wall 94, thus ventilating the rear of the pan 26.

It will be noted that the control mechanism 46 has a body portion 88 which is U-shaped in cross section configuration as shown in FIGS. 3 and 4 and rides upon the support member 32, thus helping to keep the movable control mechanism 46 in alignment during movement by the refrigerator user along the panel 52 of the stationary cover 30. There is also provided a ridge 90 molded in the stationary cover 30 which, in cooperation with a groove 92 on the control mechanism 46, acts also as a guide rail.

The foregoing is a description of the preferred embodiment of the invention and it should be understood that variations may be made thereto without departing from the true spirit of the invention as defined in the appended claims.

What is claimed is:

1. In a refrigerator, a humidity controlled pan assembly comprising:

a storage pan having an open top, a stationary cover for receiving the pan, a cover panel within the stationary cover and movable back and forth along the top of the pan, and control means including a movable control mechanism and linkage means between the control mechanism and the cover panel that moves the cover panel back and forth along the top of the pan in response to movement of the control mechanism.

2. In the refrigerator of claim 1 wherein a ramp element is located on the inner side of the cover panel that raises the cover panel relative to the top of the storage pan when the cover panel is moved rearward in response to moving the control mechanism.

3. In the refrigerator of claim 1 wherein the linkage means include a cam track member movable with the cover panel and a cam follower member located within the cam track member, said cam follower member being movable within the cam track member and fastened to and movable with the control mechanism.

4. In the refrigerator of claim 1 wherein the linkage means include two cam track members spaced laterally from and parallel to each other and a cam follower member is located within each cam track member and both being movable in unison within each cam track member and fastened to and movable with the control mechanism.

5. In the refrigerator of claim 1 wherein the top of the pan has an outwardly directed horizontal depending flange upon which the cover panel moves.

6. In the refrigerator of claim 1 wherein a resilient gasket is located between the forward end of the cover panel and the pan and will engage the front wall of the pan when the pan is in the rearward position relative to the stationary cover.

7. In the refrigerator of claim 6 wherein the gasket is stationary and will engage the cover panel when the cover panel is in the forward position relative to the stationary cover.

8. In the refrigerator of claim 1 wherein the movable control mechanism is an arm slidable within a horizontal slot located on the front of the stationary cover.

9. In the refrigerator of claim 1 wherein the movable control mechanism may be positioned anywhere between the position opening the cover panel completely and closing the cover panel completely to thereby allow variable control of the humidity in the pan.

10. In the refrigerator of claim 1 wherein the pan is supported by the stationary cover and is movable back and forth relative to the stationary cover and is removable therefrom.

* * * * *